US005858262A

United States Patent [19]

Lebensfeld

[11] Patent Number: 5,858,262

[45] Date of Patent: Jan. 12, 1999

[54] MOLD FOR FORMING MULTI-SIDED, FULLY CONTOURED, THREE-DIMENSIONAL TOY FIGURES

[75] Inventor: Steven Lebensfeld, Woodsburgh, N.Y.

[73] Assignee: Toymax Inc., Plainview, N.Y.

[21] Appl. No.: 640,430

[22] Filed: Apr. 30, 1996

Related U.S. Application Data

[63] Continuation of Ser. No. 290,240, Aug. 15, 1994, abandoned.

[51] Int. Cl.[6] ..... A63H 3/16; B29C 39/34

[52] U.S. Cl. ..... 249/98; 249/123; 249/124; 249/176; 249/177; 425/DIG. 57; 425/DIG. 58; 425/DIG. 107; 446/97

[58] Field of Search ..... 264/274, 318; 425/DIG. 57, DIG. 107, DIG. 58; 249/64, 117, 119, 123, 124, 142, 176, 177, 98, 122; 446/97, 391

[56] References Cited

U.S. PATENT DOCUMENTS

| | | | |
|---|---|---|---|
| 144,373 | 11/1873 | Walker . | |
| 1,176,209 | 3/1916 | Dice . | |
| 1,277,702 | 9/1918 | Des Combes | 446/97 |
| 1,367,134 | 2/1921 | Hachmann | 425/DIG. 107 |
| 1,369,381 | 2/1921 | Bondi . | |
| 1,566,801 | 12/1925 | Millard . | |
| 1,576,874 | 3/1926 | Stevens | 264/274 |
| 2,668,999 | 2/1954 | Baechler | 425/DIG. 57 |
| 2,718,668 | 9/1955 | Burke . | |
| 2,880,463 | 4/1959 | Lazarr | 249/124 |
| 2,885,822 | 5/1959 | Onanian . | |
| 2,896,352 | 7/1959 | Strauss | 264/318 |
| 2,920,682 | 1/1960 | Lindberg . | |
| 2,954,597 | 10/1960 | McFarland . | |
| 3,061,880 | 11/1962 | Weisbach | 425/DIG. 57 |
| 3,472,715 | 10/1969 | Weinbrenner et al. . | |
| 3,493,142 | 2/1970 | Assmann . | |
| 3,523,384 | 8/1970 | Adelsohn . | |
| 3,574,897 | 4/1971 | Citron et al. . | |
| 3,574,968 | 4/1971 | Schlan et al. | 446/97 |
| 3,598,358 | 8/1971 | Clearwaters et al. . | |
| 3,845,183 | 10/1974 | Harrison . | |
| 3,859,020 | 1/1975 | Rentz . | |
| 3,861,640 | 1/1975 | Agneta | 425/DIG. 57 |
| 3,966,166 | 6/1976 | Elliott | 425/DIG. 57 |
| 4,215,843 | 8/1980 | Gay et al. . | |
| 4,470,784 | 9/1984 | Piotrovsky . | |
| 4,657,519 | 4/1987 | Kobayashi . | |
| 4,947,527 | 8/1990 | Hennig . | |
| 4,968,282 | 11/1990 | Robson et al. . | |
| 5,061,219 | 10/1991 | Glickman . | |
| 5,088,598 | 2/1992 | Iguchi . | |

FOREIGN PATENT DOCUMENTS

| | | | |
|---|---|---|---|
| 2271940 | 5/1994 | United Kingdom | 446/391 |

*Primary Examiner*—Robert Davis
*Attorney, Agent, or Firm*—Cowan, Liebowitz & Latman, P.C.

[57] ABSTRACT

A fully contoured three dimensional toy figure made of at least two figure parts, and a toy apparatus and a method for molding the toy figure are disclosed. The figure parts are molded in respective mold cavities with receptacles, e.g., holes, in a side thereof and selected parts are joined together with simple connectors inserted into aligned receptacles of adjacently positioned parts. The receptacles may simply be blind holes in one side of the figure parts, and the connectors may be simple rods, bars or tubes which may have structure that assists in engaging the walls of the holes. The invention allows small children to make fully-contoured toy figures easily without having to use adhesives or typical fasteners to attach the figure parts together. Child-safe plastic materials such as Plasti-Goop® may be used as the plastic molding material. Also disclosed is a toy mold for use by young children in making molded figures and figure parts with a fitting attached thereto, whereby the figure or figure part may be attached to an accessory such as a hair clip, or play jewelry such as a ring or bracelet, or to another figure or figure part etc.

11 Claims, 5 Drawing Sheets

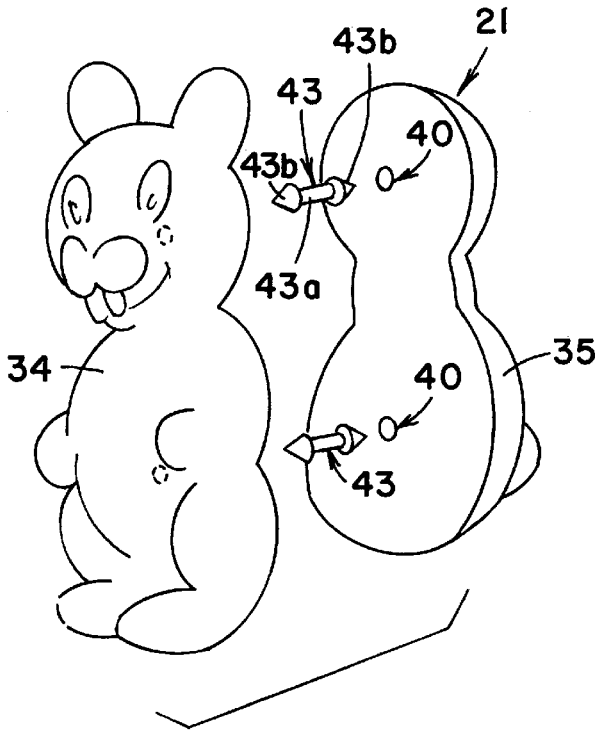
FIG. 4
FIG. 6
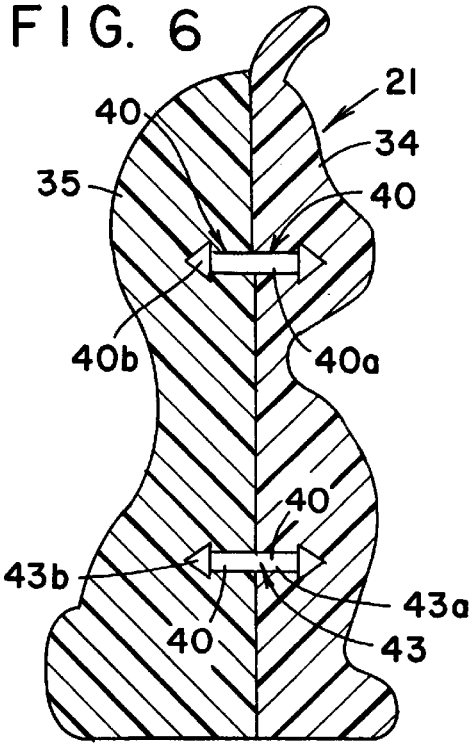
FIG. 5
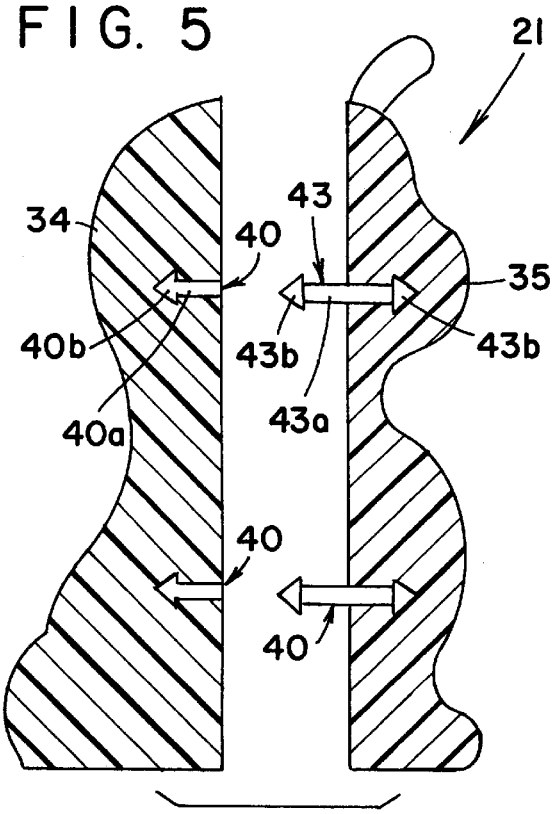

FIG. 15
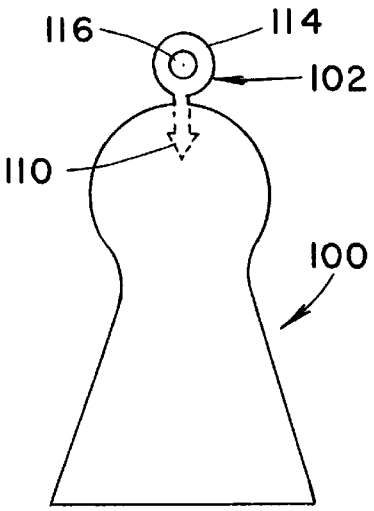
FIG. 16
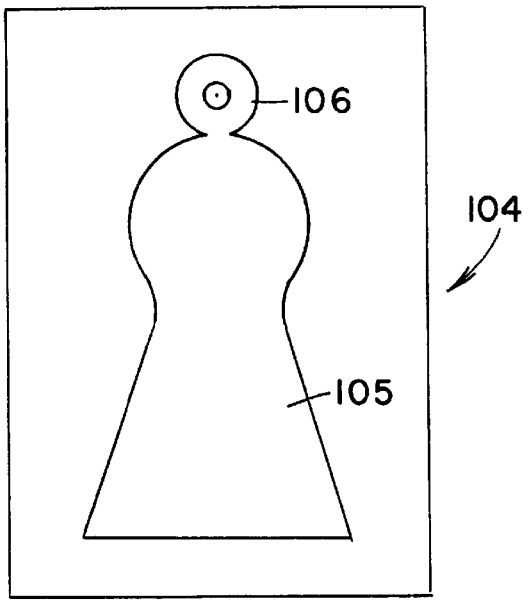
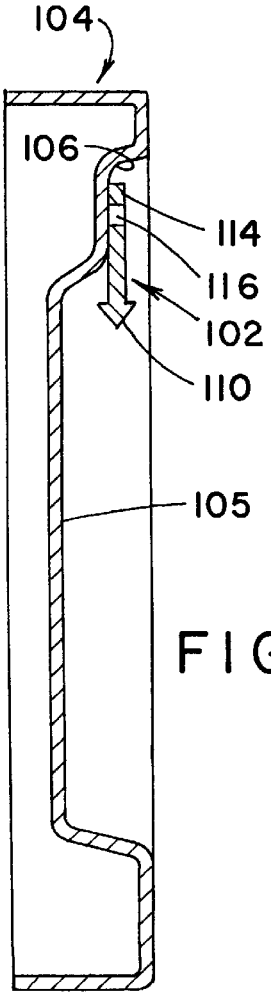
FIG. 18
FIG. 17
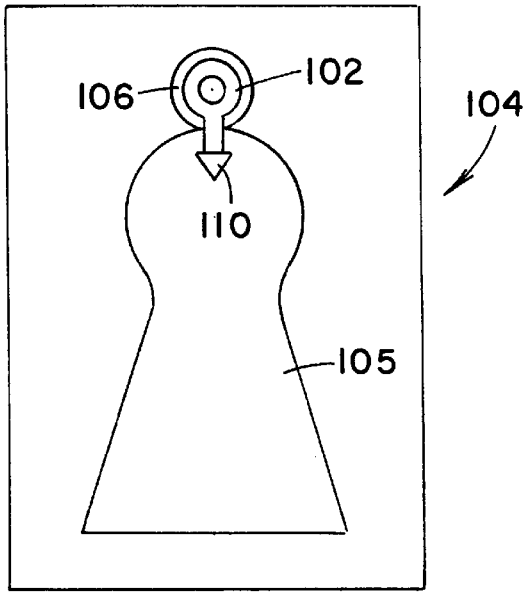

MOLD FOR FORMING MULTI-SIDED, FULLY CONTOURED, THREE-DIMENSIONAL TOY FIGURES

This application is a continuation of application Ser. No. 08/290,240, filed Aug. 15, 1994, now abandoned.

BACKGROUND OF THE INVENTION

The invention disclosed herein relates to multi-sided, fully contoured three dimensional toy figures, to toy figures having appliances or fittings (e.g., connectors pins, clips, rings, magnets, etc.) molded thereto and to toy molding apparatus and a method for molding toy figures.

U.S. Pat. Nos. 3,598,358 to Clearwaters et al. and 4,215,843 to Gay et al. disclose toy molding apparatuses which include a toy mold having one or more open cavities in which one or more corresponding toy figures are molded. U.S. Pat. No. 2,718,668 to Burke discloses molding apparatus (apparently for use on a commercial or industrial level) which includes a mold having an open cavity in which a fishing lure figure is molded. The figures formed according to the above three patents are not fully contoured, three-dimensional figures in the sense that they are flat on one side.

U.S. Pat. No. 5,088,598 to Iguchi discloses a toy kit for molding toy figures which includes one or more mold sheets having open mold cavities therein for molding parts of a toy figure from plastic material. The parts molded in the cavities may be assembled into the toy figure using an adhesive or by softening the pieces. However, the use of an adhesive or softening the figure parts is inconvenient for young children, and reduces the play value of the kit for young children.

It is known on a commercial or industrial level to form fully contoured three-dimensional toy objects in one piece using casting molding apparatus, and to form three-dimensional toy figures from two molded, hollow figure halves that are joined together, for example, as disclosed in U.S. Pat. No. 2,920,682 to Lindberg, or with an adhesive or by welding the figure halves.

OBJECTS AND SUMMARY OF THE INVENTION

It is an object of the invention disclosed herein to provide a simple and inexpensive way for young children to make fully contoured, three dimensional plastic toy figures from toy molds and plastic material.

It is another object of the invention to overcome the drawbacks of prior art toy figure molding toys such as those described in the patents referred to above.

It is another object of the invention to provide a simple and inexpensive way for children to mold toy figures with appliances attached thereto.

It is another object of the invention to increase the play value of toys used by young children for molding toy figures.

Certain of the above and other objects are achieved by a toy apparatus for molding a fully contoured three dimensional toy figure and a method for malting the same in which figure parts are molded from plastic material separately, then joined in a simple manner which does not require adhesives or typical fasteners or softening the plastic parts in order to adhere them together while in a softened state.

In the preferred embodiments, the figure parts are molded with receptacles, e.g., holes, in a side thereof and selected parts are joined together with connectors inserted into aligned receptacles of adjacently positioned parts. The receptacles may simply be blind holes in one side of the figure parts, and the connectors may be simple rods, bars or tubes which may have structure that assists in engaging the walls of the holes. For example, the connectors may simply be over-sized as compared to the holes so that they may be pushed into the holes and frictionally engage the walls of the holes, and/or the connectors may have structure shaped specifically for engaging the walls of the holes and/or complimentary shaped recesses in the holes.

In the preferred embodiments, the side of the figure with the holes therein is flat, or it may be peripherally flat, i.e., flat along the periphery and non-protruding, e.g., concave, elsewhere or in selected interior regions.

The plastic molding material is introduced in the mold cavity in a liquid, i.e., a soft and flowable state, or in a solid state, i.e., a harder, non-flowable state, and changes between solid and liquid states at least once while in the mold cavity. In one embodiment, the plastic material is introduced into the mold cavity in a first soft and flowable state, assumes the shape of the mold cavity and then solidifies in the mold cavity to a second solid state, after which the part is removed from the mold cavity. In another embodiment, the plastic material is introduced into the mold cavity in a first solid state, then it changes state while in the mold cavity to a second soft and flowable state and assumes the shape of the mold cavity, and then it solidifies in the mold cavity back to the first solid state, after which the part is removed from the mold cavity. The plastic material changes from one state to another when it is exposed to some condition or stimulus, such as heat or air or the addition of a component, for example the plastic material may be a plastic system which includes a component that remains soft until a second component is added to the system to cause it to harden.

In the one embodiment referred to above, the plastic material is injected, poured or otherwise introduced into the mold cavity at room temperature in the first soft and flowable state and assumes the shape of the cavity. The plastic material is exposed to heat while in the mold cavity to harden it and cause it to change state to the second solid state. After the part has cooled sufficiently to handle it safely, it is removed from the mold cavity. In the other embodiment referred to above, the plastic material is introduced into the mold cavity in solid form, e.g., rods, pellets, powder, etc., and is exposed to heat while in the mold cavity to liquefy the plastic material, which then assumes the shape of the mold cavity. The plastic material is cooled while in the mold cavity to harden it and cause it to change state to the second solid state. The part is removed from the mold cavity after it has cooled to a point where the plastic material has solidified and may be handled safely and without damaging the part.

The molding material may be a thermoplastic or thermoset plastic, and preferably one which is at least somewhat softer or resilient after it is molded into the toy figure. The plastic material after molding must be sufficiently soft or resilient to allow assembly of the figure parts using the simple connectors described herein and equivalents thereof If the molded plastic is too hard or too soft, the connectors may not frictionally engage the figure parts very well. The molded figure parts should have a hardness durometer of from about 10 to about 30, with about 15 to 18 being preferred.

Apparatus according to the invention includes such plastic material and a number of mold cavities having a shape or shapes defining respective parts of the toy figure to be molded. The toy figure may comprise two figure parts which are different from each other, in which case two mold cavities are provided, one for each figure part. Or the toy figure may include two figure parts which are the same, in which case only a single mold cavity need be provided. In other embodiments in which the toy figure includes more than two different parts, more than two molded cavities are provided. The toy molding apparatus further comprises means removably projecting into the respective cavity for molding the receptacles referred to above in predetermined positions of the figure parts.

As mentioned, in the preferred embodiment the receptacles are holes, and the means for molding the holes in the respective figure parts include one or more projections entering respective mold cavities from the opentop thereof so as to displace, in the shape of the projections, soft plastic material in the mold cavity. The hole-forming projections are shaped according to the holes they are to mold. The connectors and the projections are therefore related in that the connectors and projections are configured so that the connectors engage holes formed by the projections. The connectors and the projections each have ends which have a largest cross-sectional dimension, with the largest cross-sectional dimension of the connector ends being the same or slightly larger than the largest cross-sectional dimension of the corresponding projection ends such that ends of connector elements can be engaged in holes formed by corresponding projection ends in connectable figure parts. The plastic material may be introduced into the mold cavity either before or after the projection or projections are positioned in the mold cavity.

In the preferred embodiments, the projections are supported by bars, and the mold cavities are substantially surrounded by flat surfaces on which the bars are directly or indirectly supported. Means are provided for engaging and positioning a bar relative to a cavity to thereby properly position the projections in the mold cavity and to prevent the bar from moving during a molding operation. Such means for engaging the bar may comprise, feet or projections extending from the flat surface (or from the bar) which engage holes in the bar (or the flat surface), or by a recess in the flat surface in which the bar is held.

As mentioned above, the molded parts have a flat side in which the receptacles are molded, i.e., flat at least along substantial peripheral portions as described above. The figure is assembled from such parts by positioning the figure parts flat side to flat side with a connector filly seated in the receptacle of one figure part and positioned in the receptacle of the other, or partially seated in the receptacles of both figure parts, and pressing the figure parts together until the connectors are fully seated in the receptacles of both figure parts with essentially no space between the figure parts at least along substantial portions of the peripheries thereof Certain of the above and other objects are achieved by a toy apparatus and method for molding a toy figure with an appliance or fitting such as a connector, clip, pin, ring, magnet, etc., attached thereto. The appliance is attached during molding generally as described above for molding holes in the figure part, except that the fitting remains attached to the figure part. The fitting includes a projecting portion which is held in a mold cavity in place of or in addition to the projection(s) for molding the hole(s) in the molded figure. The appliance allows the molded figure to be used as an accessory, for example: when molded with a clip, the figure part may be used as a hair accessory; when molded with a pin, as a play jewelry accessory for clothing; when molded with a magnet, as a kitchen accessory or note holder; when molded with a shaped connector, as a removable ornament for a ring and other play jewelry which has a mating connector.

The invention provides a simple and inexpensive way to mold holes in and attach appliances to plastic parts which can easily be used by a child. In accordance with the invention, a child can easily position the hole forming means or appliances in the mold cavities, place plastic material in the mold cavities (in any order), cause the plastic material to assume the shape of the mold cavity, and to harden, as described herein, possibly using a toy oven which is currently commercially available from Toymax Inc., and then remove the hardened parts from the mold cavities and assemble the toy figure from the molded parts using simple connectors as described herein or use the molded figures with appliances as accessories.

BRIEF DESCRIPTION OF THE DRAWINGS

The invention is illustrated by way of example and not limitation in the figures of the accompanying drawings in which like references denote like or corresponding parts, and in which:

FIG. 4 is an exploded perspective view of a fully contoured, three dimensional toy figure made of two parts in accordance with the invention;

FIG. 5 is a cross-sectional view of the two sided toy figure shown in FIG. 4 depicting the two figure parts separated and with connectors inserted into the holes of one of the figure parts;

FIG. 6 is a cross-sectional view of the two sided toy figure shown in FIGS. 4 and 5 fully assembled with the connectors inserted into the holes of both figure parts and the two figure parts held together with substantially no space therebetween;

FIG. 15 is a perspective view of a molded figure with a fitting attached thereto according to another embodiment of the invention;

FIG. 16 is a top view of a mold according to another embodiment of the invention for use in molding the toy figure shown in FIG. 15;

FIG. 17 is a top view of the mold shown in FIG. 15 but with the fitting and the molding material in the mold, and FIG. 18 is a cross-section view of the mold shown in FIG. 17.

DESCRIPTION OF THE PREFERRED EMBODIMENTS

Figure 1:
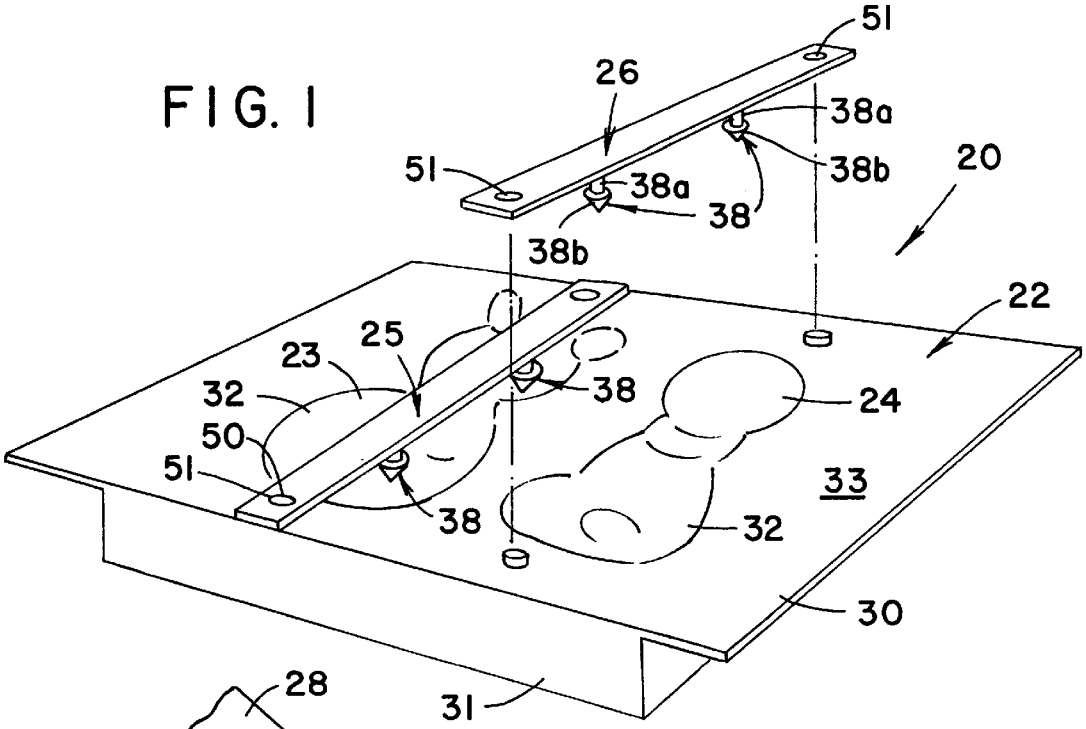
FIG. 1 is a partially exploded top perspective view of a toy mold and hole forming bars according to the invention for molding toy figure parts according to the invention.

In the preferred embodiments illustrated in the drawings, the toy figures made according to the invention include two parts, each with a flat (or peripherally flat, etc.) side, and the figure parts are joined flat side to flat side. However, the invention is also applicable to figures having more that two parts.

Figure 2:
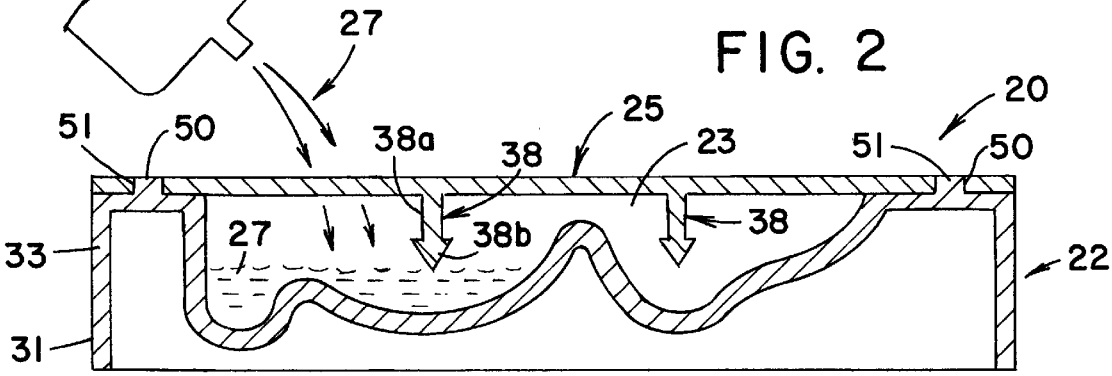
FIG. 2 is a cross-sectional view of the toy mold and a hole forming bar shown in FIG. 1 with one of the mold cavities of the mold partially filled with plastic molding material and depicting the mold cavities being filled with flowable plastic molding material.

Referring to FIGS. 1 and 2, toy molding apparatus 20 according to the invention for forming a two part toy "bunny rabbit" at FIG. 21 (FIGS. 4–6) comprises a mold 22 in which are formed two mold cavities 23, 24, one for each of the two parts of the toy FIG. 21 to be molded, hole forming bars 25, 26 (hole forming means) and plastic molding material 27 dispensed from a plastic squeeze bottle 28. The mold 22 includes a mold sheet 30 in which are formed the cavities 23 and 24, and a hollow base 31 extending around the periphery of the sheet 30 at a height which exceeds the depth of the mold cavities 23 and 24. The mold cavities 23, 24 have an open top 32 and are surrounded by the flat surfaces 33 (mold cavity supporting means) of the top of the mold sheet 30.

Mold 22 (FIG. 1) is made of aluminum or zinc and is conventionally constructed, except perhaps for the fact that it includes two mold cavities-shaped to form one of two parts 34, 35 (FIG. 4) of a two-part, fully contoured, three dimensional plastic FIG. 21. The mold cavities 23, 24 illustrated in FIGS. 1 and 2 are shaped to form the front and rear parts 34, 35 of the "bunny rabbit" 21 shown in FIG. 4. The mold cavities 23, 24 may take different shapes depending upon the figure to be made. The mold 22 depicted in FIGS. 1 and 2 is roughly 3"×3" in size, but may be made in many different sizes and shapes.

The hole forming bars 25, 26 (FIG. 1) each include two projections 38 which extend perpendicularly from a same side thereof The projections 38 are positioned on respective bars 25, 26 to form holes 40 (FIGS. 4 and 5) in respective molded figure parts 34, 35 which in the assembled condition of the toy FIG. 21 are in alignment directly opposite each other. The projections 38 include a tubular part 38*a* which terminates at its free end in a conical end 38*b*, and form complimentary shaped blind holes 40 (FIGS. 5 and 6) which include a tubular part 40*a* and a conical end 40*b*. A connector 43 (FIGS. 4 and 5) used to connect the two figure parts includes a central tubular part 43*a* which terminates at opposed free ends in conical ends 43*b*. The largest cross-sectional dimension of the conical end 38*b* of a projection 38, which is the diameter of the conical end 38*b*, is about the same as the largest cross-sectional dimension of the connector end 43*b* of the connector 43, which is the diameter of the conical end 43*b*. The conical ends 43*b* of the connector 43 are received and engaged in respective conical ends 40*b* of respective holes 40 to attach the two figure parts together, as shown in FIG. 6. The hole forming bars 25, 26 and projections 38 are also made of aluminum.

Figure 3:
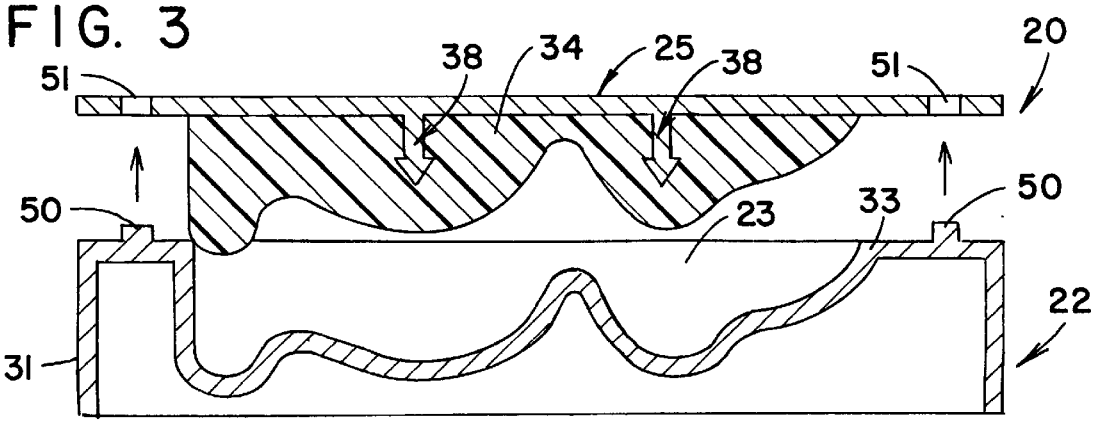
FIG. 3 is a cross-sectional view of the mold and one of the hole forming bars shown in FIG. 1 and a solidified plastic part, and depicting the solidified plastic part being removed from the mold with the hole forming bar still inserted into the solidified plastic part.

Referring to FIGS. 1–3, each bar 25, 26 is supported at opposite ends thereof on the flat surface 33 of the mold sheet 30 adjacent the respective mold cavity, and is positioned with respect to the respective mold cavity by projections 50 (FIGS. 2 and 3) received in holes 51 so that the hole forming projections 38 enter into the respective mold cavities 23, 24 at the proper locations.

The toy "bunny rabbit" FIG. 21 depicted in FIG. 4 may be formed by a young child in accordance with the invention using mold 22, bars 25, 26 and plastic molding material 27 as follows. The child positions the hole forming bars 25, 26 over the respective mold cavities 23, 24 simply by aligning the projections 50 on the mold 30 sheet 30 with the holes 51 at the ends of the hole forming bars. Next, the child fills the mold cavities with plastic molding material 27, which in the embodiment illustrated in FIG. 2 is flowable at room temperature and is supplied in a squeezable plastic container 28.

The child then hardens the plastic material, typically by introducing the mold into a toy oven, for example available from Toymax Inc. as part of its CREEPY CRAWLER® line. The time needed to harden the molded part depends on the plastic material and the temperature to which it is heated. Also, depending on the plastic material, it may be made to harden in other ways, for example, simply by exposing it to air at room temperature, or as described above.

After the plastic material 27 has hardened in the respective mold cavities (FIG. 3), the child simply removes the formed parts 34, 35 from the respective mold cavities. This may be done by turning the mold upside, shaking it, etc., or by lifting the parts out of the mold cavity by the hole-forming bars 25, 26. The hole forming bars may then be easily separated from the parts. In the preferred embodiment, the plastic material 27 is is resilient after it hardens so that the formed figure parts 34, 35 are resilient and flex to allow easy removal of the projections 38 of the bars 25, 26. Alternatively, the plastic part may be hard and the projections can be made of resilient material.

After the individual parts 34 and 35 have been formed and separated from the mold cavities and from the hole-forming bars, respective connectors 43 are inserted into the respective holes of one figure part 34 as shown in FIG. 5. Where a toy oven is used such as those available from Toymax Inc., the heated mold can not be removed from the oven until it has cooled to a predetermined safe temperature. With the connectors 43 inserted into the holes of figure part 34 (FIG. 5), the other figure part 35 is placed adjacent figure part 34 with the flat sides of the figure parts back to back and the connectors 43 aligned with the holes 40 in the other figure part 35, and the figure parts are simply pressed together (FIG. 6).

Figure 12:
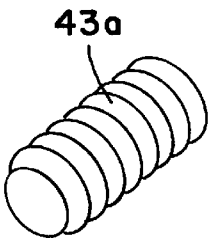
FIG. 12 is perspective view of the connector used to connect the two figure parts of the molded figure shown in FIG. 11.

To prevent the parts from detaching after they have been attached, the diameter of the tubular portion 40*a* (FIG. 6) of the blind holes 40 is smaller than the tubular portion 43*a* of the connectors 43 so that a connector is tightly received in the hole. The conical ends 43*b* of the connectors 43 are received in the conical part 40*b* of the holes 40 and function much like arrow heads to resist separation of the connectors from the figure parts. However other structure may be used to engage the connectors in the holes and resist removal of the connectors from the holes. If desired, blind holes 40 may be made tubular without a conical portion. In that embodiment, projections on bars 25, 26 would also be tubular, and a ridged or serrated connector such as connector 43*a* (FIG. 12) may be used, and the largest cross-sectional dimension of the connector end would be the diameter of the connector at the ridge of a serration, the largest cross-sectional dimension of the projection end would be the diameter thereof, and the ridge of a serration would be slightly larger than the diameter of the projection end.

As is clearly evident from the above description and drawings, a young child utilizing the invention can mold filly contoured, three-dimensional toy figures without difficulty.

A molding material 27 (FIG. 2) which is safe for children to use, is flowable at room temperature and which hardens when heat is applied to it in the presence of air is sold by Toymax Inc. under the trademark PLASTI-GOOP®(a plastisel). PLASTI-GOOP® material is resilient when it solidifies, so that a young child may easily remove the hole-forming bars 25, 26 and may easily insert the connectors 43 into the holes 40 which flex somewhat to engage the connectors. Other plastic materials which flow at room temperature and harden when heated, that are safe for use by children and are preferably resilient when they harden may also be used.

Figure 7:
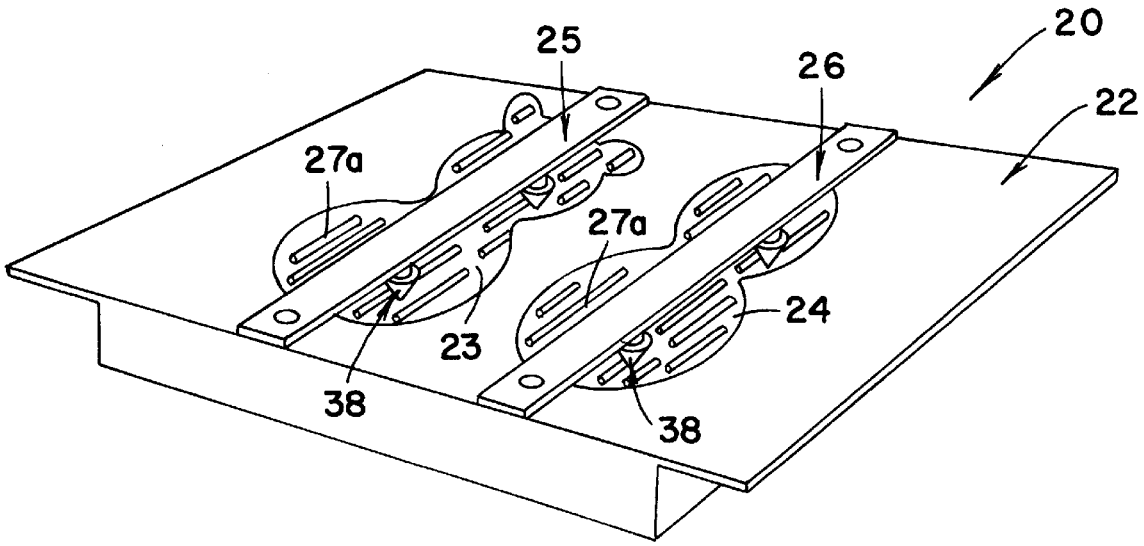
FIG. 7 is top perspective view of the mold and hole forming bars depicted in FIG. 1 with solid plastic molding material in the mold cavities.

In another embodiment, plastic material 27*a* (FIG. 7) which is solid at room temperature may be used. In this embodiment, the plastic material 27*a* is softened by heat to cause it to flow, and then solidifies when cooled. A child places the plastic material 27*a* in rod form (or in pellet, powder or other solid form) in the mold cavities 23 ,24, as shown in FIG. 7. The hole forming bars 25, 26 are positioned as described above, either before or after the plastic material 27*a* has been introduced into the mold cavities. Plastic material 27*a* may be a thermoset plastic such as a blend of wax and polyethylene or styrene.

The child next heats the mold cavities with the plastic material 27*a* therein to cause the plastic material to soften, flow and assume the shapes of the mold cavities 23, 24. Then the child cools the mold cavities to solidify the parts. A toy oven may be used to heat the molds, and they may be cooled to a safe temperature in the oven, and thereafter cooled to room temperature outside of the oven. After the parts have cooled to room temperature, the child removes the parts and joins them as described above. The plastic material 27*a* also is preferably resilient when it hardens.

In accordance with the invention, mold 22, bars 25 and 26, connectors 43 and plastic material 27 and/or 27*a* are sold together as a kit. Any conventional packaging may be employed, for example, a carton, or a bubble pack in which at least one mold, plastic material, e.g., in a squeeze bottle, hole forming bars, and connectors are held against a relatively rigid backing such as cardboard with a plastic sheet. The connectors may be enclosed in plastic or a compartment may be provided for them. The kit may also include a toy oven such as the one sold by Toymax Inc. in its Creepy Crawler® line. The packaging would then be a carton similar to the carton in which the toy oven and other Creepy Crawler® items are sold.

Figure 8:
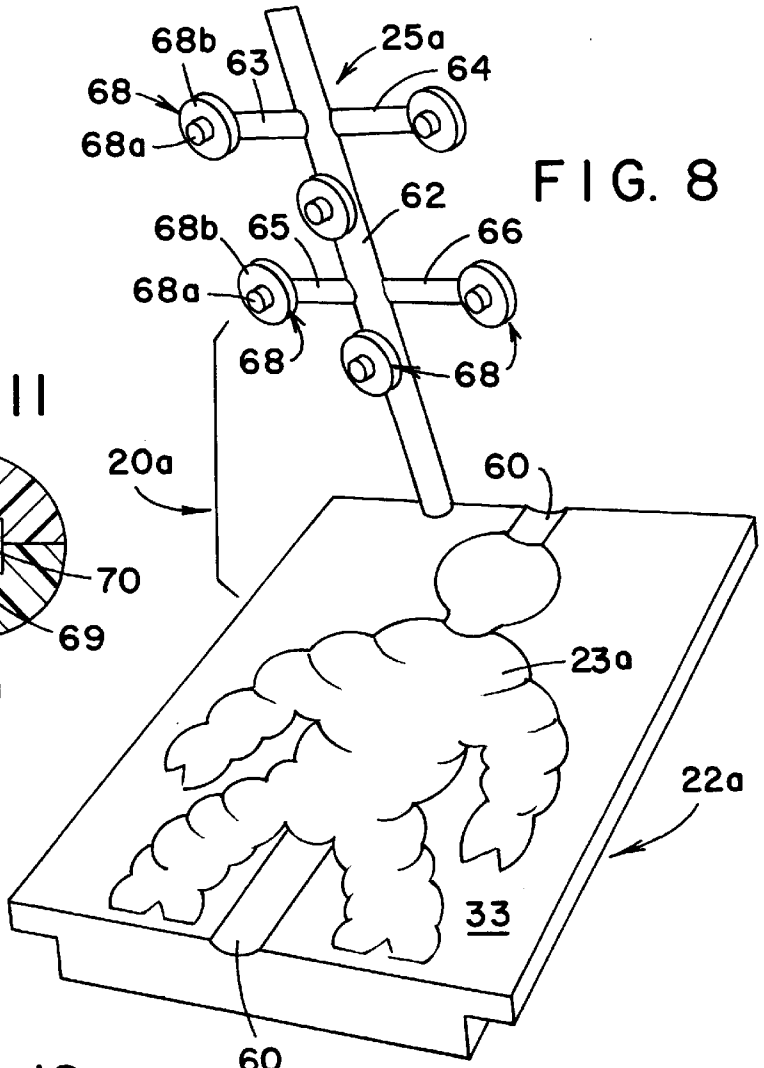
FIG. 8 is an exploded perspective view of a mold and a hole forming bar according to another embodiment of the invention.
Figure 11:
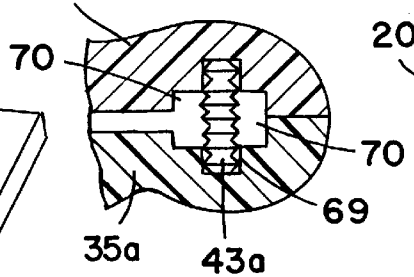
FIG. 11 is cross-sectional view of a portion of an assembled toy figure molded with the mold and the hole forming bar depicted in FIG. 8.
Figure 10:
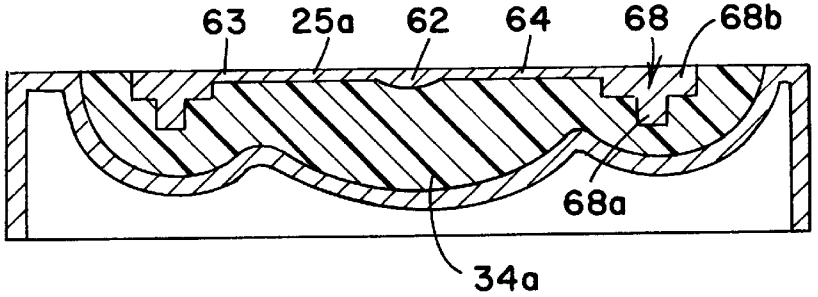
FIG. 10 is a cross-sectional view of the mold and the hole forming bar shown in FIG. 9 taken transversely through the mold and the hold forming bar, with the mold cavity filled with plastic material.
Figure 9:
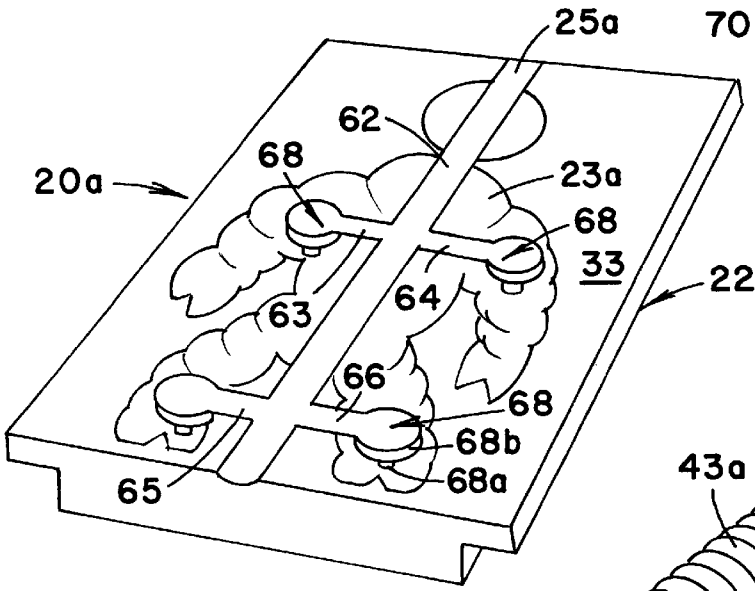
FIG. 9 is a perspective view of the mold and the hole forming bar shown in FIG. 8 with the hole forming bar seated on the mold.

FIGS. 8 and 9 depict another embodiment of a mold 22*a* and a hole forming bar 25*a*, which differ from those shown in FIG. 1. Mold 22*a* may be used to make a monster figure (not fully shown) made of two identical figure parts 34*a*, 35*a* (FIGS. 10 and 11). Mold 22*a* includes a single mold cavity 23*a* which is used to make both figure parts 34*a*, 35*a*. Mold 22*a* includes a curved recess 60 in the flat top surface 33 thereof for positioning the hole-forming bar 25*a* which includes a semi-cylindrical longitudinal part 62 that fits into the curved recess 60. The bar 25*a* resembles a tree and has four branches or arms 63–66 extending transversely from the longitudinal part 62.

Referring to FIGS. 8 and 10, two projections 68 extend from the longitudinal part 62 of the bar and four projections 68 extend from the arms 63–66 for forming respective cylindrical holes 69 in the toy figure parts 34*a*, 35*a*. The projections 68 include a tubular end 68*a*, but not the conical end 38*b* of projections 38. Referring to FIG. 10, the tubular end 68*a* of the projection extends from a cylindrical, larger diameter part 68*b* of the projection. The larger diameter cylindrical part 68*b* forms a cylindrical cavity 70 (FIG. 11) in the figure part 34*a*, 35*a* and the smaller diameter tubular part 68*a* of the projection forms the cylindrical hole 69 opening into the cavity 70. Thus, hole 69 is recessed from the flat side of the toy figure parts 34*a*, 35*a*. The cavities 70 create an air gap (FIG. 1 1) between joined figure parts 34*a*, 35*a*., which facilitates assembly in that the parts may more easily be pressed together.

The monster toy figure (FIG. 8) has arms and legs, and six holes 69 are molded into toy figure parts 34*a*, 35*a* to securely hold the figure parts together including the arms and legs thereof Each toy figure part 34*a*, 35*a* has a contoured side and a flat side (except for the cavities 70), and they are molded, separated from the mold cavities, and joined in generally the same manner as described above, except that one toy figure part is made per mold, the blind holes 69 are tubular and recessed from the flat side of the figure part, and the connectors 43*a* are tubular and have a ridged or serrated surface resembling a screw thread for better engaging the walls of the cylindrical hole 69. A kit for molding a toy monster figure includes a mold 22*a*, a hole forming bar 25*a*, connectors 43*a* and plastic material 27, 27*a*, and may include a toy oven, as described above.

The connectors 43, 43*a* may be made of plastic, e.g., Nylon, Delrin, ABS or any child-safe plastic material which has sufficient rigidity to allow assembly of the toy figure parts and hold them together.

Figure 13:
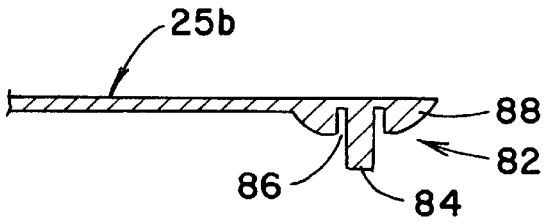
FIG. 13 is a cross-sectional view of a projection extending from a hole forming bar according to another embodiment of the invention.
Figure 14:
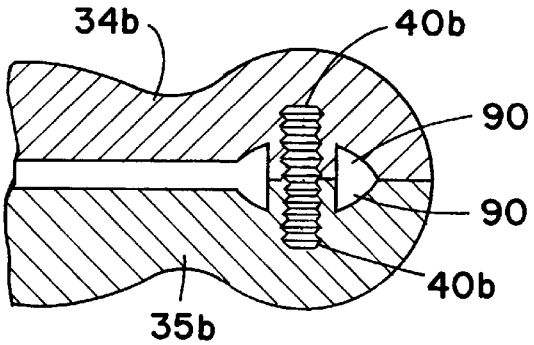
FIG. 14 is a section view of a portion of a two part toy figure molded using the projection depicted in FIG. 13.

FIGS. 13 and 14 illustrate another embodiment of a hole molding bar 25*b* for molding blind cylindrical holes 40*b* in toy figure parts 34*b*, 35*b*. The blind holes 40*b* are created by projections 82 each having a solid tubular end 84 surrounded by an annular space 86. The tubular ends 84 extend from a semi-spherical portion 88, which forms a semi-spherical cavity 90 in the mold parts 34*b*, 35*b*. The annular space 86 surrounding the tubular end 84 forms a hollow sleeve with blind hole 40*b* therein passing through the cavity 90 and opening at or adjacent the flat side of the figure part. The semi-spherical portions 88 of the projections form a spherical air space (which facilitates assembly as mentioned above) between two assembled toy figure parts, as shown in FIG. 14.

Hole forming bar 25*b* may be otherwise configured as hole forming bar 25, and may be used as described above to form figure parts of a toy figure as described above. Also, a kit may include a hole-forming bar 25*b* rather than a hole forming bar 25 or 25*a*, and connectors 43*a* and plastic material 27 and/or 27*a*.

Referring to FIGS. 15–18, a figure or figure part 100 (FIG. 15) may be molded with a ring appliance or fitting 102 attached thereto. FIG. 15 shows a bell figure which may be attached to a charm bracelet (not shown) by means of the ring fitting 102. A mold 104 used for making the FIG. 100 includes a mold cavity 105 similar to a mold cavity 23 or 24 of mold 22 but which also includes a recess 106 adjacent a side of the mold cavity 105 for holding the ring fitting 102 during molding. The fitting 102 includes an arrow-shaped end 110 similar to the end 43*b* of connector 43 which becomes embedded in and engaged by the molding material after the molding material hardens in the mold cavity 105. The other end 114 of the ring fitting 102 includes a hole 116 which may be used to attach the figure to the charm bracelet. The fitting may be made of metal or the same plastic materials as described above for connectors 43, 43*a*, and has sufficient rigidity to be captivated within the molded FIG. 100 so as to suspend the molded figure from the bracelet. If desired, FIG. 100 may be made fully contoured as described above, and the fitting 102 may be molded into the figure as described above, or it may be inserted after the figure parts are joined. When the fitting is inserted after the figure parts are molded, a recess may be formed in a figure part or parts to receive the fitting. The fitting may include instead of a ring, part of a connector for a snap fit, interlocking slide fit, a poppet connection, a bayonet connection, etc., or a pin, magnet, etc.

Fully-contoured three dimensional figures may also be made by molding figure parts with the mating fittings attached thereto, as described above. In such embodiments, instead of making a hole with a projection 38, the fitting projects into the mold and is embedded in the molding material during the molding process. Fittings may be removably attached to a bar which is supported in the same manner as the hole forming bars 25, 26. For example, the fittings may be snapped into the bars, attached by adhesive, etc.; the bar and fittings may be made of plastic with the fittings molded thereto and removable therefrom by weakened portions which allow the fittings to be easily severed from the bar; in this case, the plastic bar is disposable. Many different figure parts may be molded in accordance with the invention, in the form of many different accessories. The fitting may also take many different forms, depending upon how it is to be attached to an accessory. Thus, the fitting end 114 may be a simple one-piece connector such as the ring connector described above, or part of a two-part connector, the other part of which may be attached to a ring, bracelet, necklace, other toy figure, etc. Many two-part connectors are known or will be apparent to those skilled in the art, and the invention encompasses toy figures with such connectors.

Although the invention has been described with reference to preferred embodiments, it will be apparent to one skilled in the art that variations and modifications are contemplated within the spirit and scope of the invention. For example, the specific shapes of the mold cavities may vary, and the number of mold cavities formed in a mold may vary, and the number of figure parts required to form a toy figure may vary. Also, plastic materials other than those identified herein may be used. Such materials will change state when exposed to a condition such as heat or air or an additional plastic material, and will be safe for children to use. The drawings and description of the preferred embodiments are made by way of example rather than to limit the scope of the invention, and it is intended to cover within the spirit and scope of the invention all such changes and modifications.

What is claimed is:

1. Toy apparatus for making a fully contoured, three-dimensional plastic figure from a plurality of connectable figure parts, comprising:

at least two mold cavities for making said figure parts, each mold cavity having an outline shape defining a respective figure part and an open top through which plastic molding material can be introduced therein and through which a figure part molded therein can be removed therefrom when said plastic material is in a hardened state, said outline shapes of at least portions of said at least two mold cavities being generally the same;

one or more hole-forming projections, each having an end extending in each of said at least two mold cavities in the same respective positions relative to the outline shapes of said portions having generally the same outline shapes for molding respective holes in the respective figure parts; and one or more connector elements, each having opposed ends, respective connector element ends and projection ends having a largest cross-sectional dimension, the largest cross-sectional dimension of a connector element end being the same as or slightly larger than the largest cross-sectional dimension of a corresponding projection end such that respective connector element ends can be engaged in aligned holes of respective connectable figure parts, for joining connectable figure parts into said fully contoured, three-dimensional figure.

2. The toy apparatus of claim 1 comprising a one-piece mold having said at least two more mold cavities therein.

3. The toy apparatus of claim 1 comprising a first mold having a first of said at least two mold cavities therein and a second mold having a second of said at least two mold cavities therein.

4. The toy apparatus of claim 1 wherein said hole forming projections are positioned in said at least two mold cavities to produce said holes as blind holes.

5. The toy apparatus of claim 4 wherein each of said at least two mold cavities is shaped to form one part of a two-part figure.

6. The toy apparatus of claim 1 comprising means for supporting each said hole-forming projection extending into said at least two mold cavities through said top thereof.

7. The toy apparatus of claim 6 comprising mold cavity supporting means for supporting each of said at least two mold cavities, and wherein said means for supporting said hole-forming projections is supported by said mold cavity supporting means.

8. The toy apparatus of claim 7 wherein said mold cavity supporting means comprises a flat surface surrounding said at least two mold cavities and wherein said supporting means for said hole-forming projections comprises a bar from which said projections extend, said bar being supported by said flat surface.

9. The toy apparatus of claim 8 comprising means for positioning said bar on said flat surface so as to position said projections at desired locations in said at least two mold cavities.

10. The toy apparatus of claim 7 wherein said mold cavity supporting means comprises a flat surface surrounding said at least two mold cavities and a recess in said flat surface, and wherein said supporting means for said hole-forming projections comprises a bar from which said projections extend, said bar being supported in said recess.

11. The toy apparatus of claim 1 including means projecting into said one or more mold cavities for molding a cavity in a respective figure part adjacent each said hole.

* * * * *